US009702109B2

(12) United States Patent
Pionetti

(10) Patent No.: US 9,702,109 B2
(45) Date of Patent: Jul. 11, 2017

(54) DEVICE FOR ANCHORING A RACEWAY MOUNTING OF A SEABED-TO-SURFACE FACILITY

(71) Applicant: SAIPEM S.A., Montigny le Bretonneux (FR)

(72) Inventor: Francois Regis Pionetti, La Baleine (FR)

(73) Assignee: Saipem S.A., Montigny le Bretonneux (FR)

( * ) Notice: Subject to any disclaimer, the term of this patent is extended or adjusted under 35 U.S.C. 154(b) by 0 days.

(21) Appl. No.: 14/890,863

(22) PCT Filed: May 12, 2014

(86) PCT No.: PCT/FR2014/051096

§ 371 (c)(1),
(2) Date: Nov. 12, 2015

(87) PCT Pub. No.: WO2014/184480

PCT Pub. Date: Nov. 20, 2014

(65) Prior Publication Data

US 2016/0115667 A1 Apr. 28, 2016

(30) Foreign Application Priority Data

May 13, 2013 (FR) ..... 13 54277

(51) Int. Cl.
*E02D 27/52* (2006.01)
*E21B 17/01* (2006.01)
(Continued)

(52) U.S. Cl.
CPC ..... *E02D 27/525* (2013.01); *E02B 17/02* (2013.01); *E02D 27/10* (2013.01); *E02D 27/50* (2013.01);
(Continued)

(58) Field of Classification Search
USPC ..... 405/158, 169, 170, 171, 172, 224.2, 405/224.3, 224.4; 116/345, 350, 367
See application file for complete search history.

(56) References Cited

U.S. PATENT DOCUMENTS 5,575,590 A * 11/1996 Drost ..... F16L 1/163 405/166
2004/0126192 A1* 7/2004 Nish ..... E21B 17/012 405/224.2
2011/0226484 A1 9/2011 Lavagna

FOREIGN PATENT DOCUMENTS

EP 0 251 488 1/1988
FR 2954966 * 1/2011
(Continued)

OTHER PUBLICATIONS http://www.thefreedictionary.com/middle.*
(Continued)

*Primary Examiner* — Sean Andrish
(74) *Attorney, Agent, or Firm* — Cozen O'Connor

(57) ABSTRACT

A device and method for anchoring a raceway mounting of a seabed-to-surface facility. The apparatus having a rigid structure immersed in a subsurface by floats and anchored to the sea bottom by tension legs, the device suitable for supporting troughs in a bottom-to-surface connection installation, having a plurality of flexible lines extending to the sea bottom, the flexible lines being supported by the troughs, the trough support structured is connected to a base resting on and/or anchored to the bottom of the sea by a plurality of n tension legs tensioned in parallel, by the float, n being not less than six, each of a plurality of p tension legs from the n tension legs, where p is not less than (n−2) being connected at one of its ends to a distance-varying device secured
(Continued)

to the base or to the support structure, the distance-varying device suitable for varying the distance between the support structure and the base.

20 Claims, 5 Drawing Sheets

(51) Int. Cl.

| | |
|---|---|
| ***E21B 41/08*** | (2006.01) |
| ***E02B 17/02*** | (2006.01) |
| ***E02D 27/10*** | (2006.01) |
| ***E02D 27/50*** | (2006.01) |
| *E02B 17/00* | (2006.01) |

(52) U.S. Cl.
CPC ..... *E21B 17/01* (2013.01); *E21B 17/012* (2013.01); *E21B 41/08* (2013.01); *E02B 2017/0095* (2013.01)

(56) References Cited

FOREIGN PATENT DOCUMENTS

| | | |
|---|---|---|
| FR | 2 954 966 | 7/2011 |
| WO | WO 00/31372 | 6/2000 |
| WO | WO 02/066786 | 8/2002 |
| WO | WO 02/103153 | 12/2002 |
| WO | WO 2007/045850 | 4/2007 |
| WO | WO 2011/061422 | 5/2011 |

OTHER PUBLICATIONS

Jairo Bastos De Araujo et al. "OMAE2011-50167 Installation of a Submerged Buoy for Supporting Risers (BSR) System in Campos Basin Site" Proceedings of the ASME 2011 30$^{th}$ International Conference on Ocean, Offshore and Arctic Engineering OMAE2011, Mar. 14, 2011, XP055092725.

* cited by examiner

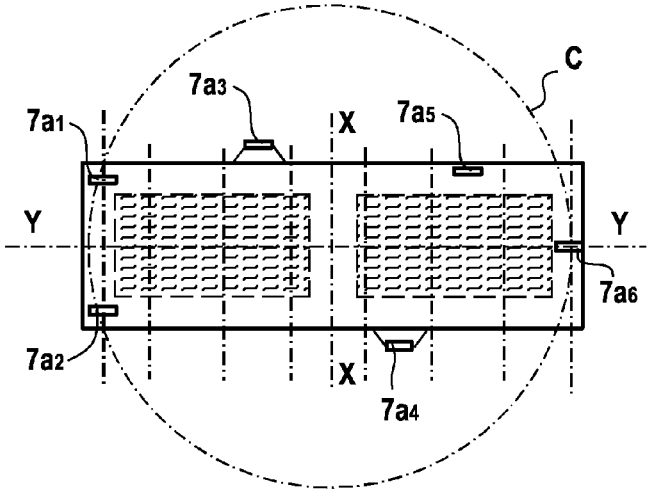
FIG.3E
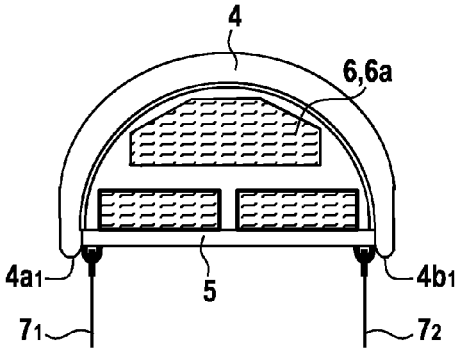
FIG.4A
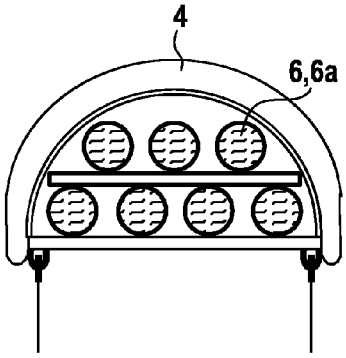
FIG.4B
FIG.5
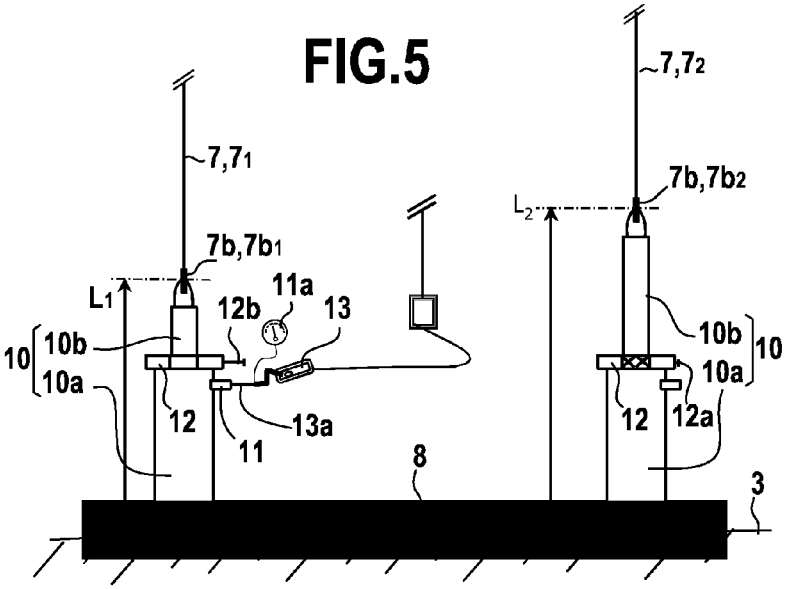
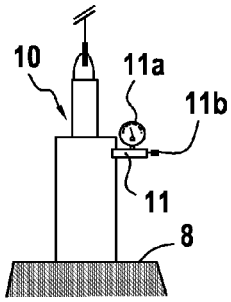
FIG.6

DEVICE FOR ANCHORING A RACEWAY MOUNTING OF A SEABED-TO-SURFACE FACILITY

PRIORITY CLAIM

This is a U.S. national stage of application No. PCT/FR2014/051096, filed on May 12, 2014. Priority is claimed on France Application No.: FR1354277 filed May 13, 2013, the content of which is incorporated herein by reference.

BACKGROUND OF THE INVENTION

1. Field of the Invention

The present invention relates to a device for anchoring a rigid structure kept submerged in the subsurface by floats and anchored to the sea bottom by tension legs that are useful for supporting a plurality of arch-shaped support and guide elements referred to as troughs in a bottom-to-surface connection installation between a common floating support and the sea bottom.

More particularly, the present invention relates to an installation of multiple flexible bottom-to-surface connections between well heads, pieces of equipment, or the ends of undersea pipes resting on the sea bottom, and a floating support on the surface, the installation comprising a multiplicity of flexible lines, in particular flexible pipes, having their bottom ends connected to the ends of a plurality of undersea pipes resting on the sea bottom or directly to well heads or to pieces of equipment resting on the sea bottom.

In the present description, the term "flexible line" is used to mean pipes or cables capable of accepting large amounts of deformation without that giving rise to significant return forces, such as the flexible pipes defined below, and also cables or pipes for transferring power or information such as electric cables, control cables, or hydraulic fluid transfer pipes powering hydraulic equipment such as actuators, or pipes containing optical fibers; a flexible line may also be a control umbilical made up of one or more hydraulic pipes and/or electric cables for transmitting power and/or information.

The technical sector of the invention is more particularly the field of fabricating and installing bottom-to-surface connections for extracting oil, gas, or other soluble or meltable material or mineral material in suspension from under the sea, via a submerged well head, and up to a floating support, in order to develop production fields located off-shore at sea. The main and immediate application of the invention lies in the field of oil production.

2. Description of Related Art

In general, the floating support has anchor means enabling it to remain in position in spite of the effects of currents, wind, and swell. It also generally includes means for storing and processing oil together with off-loading means for discharging oil to off-loading tankers, which tankers call at regular intervals to take away the production. The common term for such supports is floating production storage and off-loading supports, and they are referred to throughout the description below by the initials FPSO.

However it is also possible for the support to be a semi-submersible floating platform installed temporarily at sea for a few years, e.g. while waiting for an FPSO type floating support to be built and installed permanently.

Bottom-to-surface connections with an undersea pipe resting on the sea bottom are known, that are of the hybrid tower type and that comprise:

- a vertical riser having its bottom end anchored to the sea bottom via a flexible hinge, that is connected to a said pipe resting on the sea bottom, and that has its top end tensioned by a float submerged in the subsurface, the top end being connected to the float; and
- a connection pipe, in general a flexible connection pipe, between the top end of said riser and a floating support on the surface, and, where appropriate, said flexible connection pipe under the effect of its own weight taking up the shape of a hanging catenary curve, i.e. going down well below the float before rising again up to the floating support.

Bottom-to-surface connections are also known that are made by continuously raising strong rigid pipes up to the subsurface, such pipes being made of thick-walled tubular elements of steel that are welded or screwed together, and that take up a catenary configuration with curvature that varies continuously throughout the suspended length, which pipes are commonly referred to as steel catenary risers (SCR) or else as "catenary type rigid pipes" or as "SCR type risers". Such a catenary pipe may go up as far as the support floating on the surface, or only as far as a float submerged in the subsurface that serves to tension its top end, which top end is then connected to a floating support by a hanging flexible connection pipe.

Bottom-to-surface connections are also known that enable a floating support to be connected to pipes or installations on the sea bottom that are constituted entirely by flexible pipes, in particular when the depth of water is not very great, e.g. lying in the range 300 meters (m) to 750 m, or even 1000 m, where the well heads or the pieces of undersea equipment are not very far from said floating support.

It should be recalled that the term "flexible pipe" is used herein to mean pipes, sometimes also known as "hoses", that are well known to the person in the art and that are described in standards documents published by the American Petroleum Institute (API), more particularly under the references API 17J and API RP 17 B. Such hoses are particularly fabricated and marketed by the company TECHNIP-COFLEXIP France. Such flexible pipes generally comprise inner sealing layers of thermoplastic materials associated with layers that withstand pressure inside the pipe, generally made of steel or of composite materials and in the form of strips wound in touching spiral turns inside the thermoplastic pipe in order to withstand the internal bursting pressure, and associated with external reinforcement over the tubular thermoplastic layer and likewise in the form of strips that are spiral-wound with touching turns, but at a longer pitch, i.e. with a smaller angle of inclination for the helix, in particular lying in the range 15° to 55°.

Under such circumstances, each of said bottom-to-surface connections needs to be kept apart from its immediate neighbors in order to avoid any interference and any impacts, not only between floats, but also between flexible pipes and electric cables and other flexible lines such as electric cables or umbilicals transferring information signals and providing the connection with said floating support, when said flexible pipes are subjected to the effects of current, and when said floating support is itself subjected to swell, wind, and current.

In the development of certain fields, each of the well heads is connected individually to a said floating support and there are therefore very many bottom-to-surface connections, so it becomes impossible to install any more since the length of the side of the support is limited and as a result it can accept only a limited number of bottom-to-surface connections.

It is desired to install as many bottom-to-surface connections as possible from a given floating support in order to optimize the working of oil fields. That is why various systems have been proposed enabling a plurality of vertical risers to be associated with one another in order to reduce the occupancy of the working field and in order to be able to install a larger number of bottom-to-surface connections connected to a common floating support. Typically, it is necessary to be able to install up to 30 or even 40 bottom-to-surface connections from a common floating support.

Documents WO 02/66786, WO 02/103153, and WO 2011/061422 in the name of the Applicant describe hybrid towers with multiple flexible pipes and risers arranged in fans enabling a large number of connections to be associated with a common floating support in spite of the problem of the movements of said risers interfering with one another since they are all subjected to the same movement as their top tensioning floats under the effect of the movements of the floating support on the surface where it is subjected to swell, wind, and currents.

In those installations, proposals are made to arrange two flexible pipes that are superposed or arranged side by side between the floating support and the top ends of risers or SCRs, the two flexible pipes being guided in the subsurface by two respective troughs fastened in superposed or laterally offset manner to a float for tensioning a third riser that is located closer to the floating support than are the first two risers, each said trough thus defining two flexible pipe portions in the form of hanging double catenaries on either side of the trough. That configuration presents the advantage of making it possible to bring the flexible pipes to the top end of the riser that is relatively far from the floating support without the bottom points of said hanging double catenary pipe portions being too deep.

When a multiplicity of bottom-to-surface connections are used that are constituted exclusively by flexible pipes, it is also necessary to space the various connections apart from one another, at least for the following reasons.

Firstly, flexible pipes have fragile outer sheaths, and it is essential to prevent them from striking against one another.

Secondly, the flexible pipes are used by passing via arch-shaped guide elements referred to as "troughs", each defining a rigid bearing surface of convex curved shape as described below, so as to define two flexible pipe portions, comprising a first flexible pipe portion in a hanging double catenary configuration between the floating support and said trough, and a second flexible pipe portion in a single catenary configuration between said trough and the point of tangential contact between said flexible pipe and the sea bottom.

Those arch-shaped guide elements referred to as troughs are well known to the person skilled in the art, they present:

- a longitudinal section of curved shape in section in the axial vertical longitudinal plane of the trough, preferably a section of circular shape with its concave side facing towards the bottom of the sea, and a convex outside surface on which the pipe is placed; and
- a cross-section in the vertical plane perpendicular to the vertical axial longitudinal plane of the trough presenting a shape with a curved bottom that is preferably circular with its concave side facing upwards and constituted by said top outside surface lying between longitudinal side walls serving to hold and guide the pipe in the longitudinal direction between said side walls.

In known manner, the radius of curvature of the longitudinal curve with its concave side facing downwards is greater than the minimum radius of curvature of the pipe passing via said trough.

Such a trough serves to impart controlled curvature to the portion of flexible pipe that it supports so as to avoid excessive curvature which would irremediably damage said pipe.

The function of such troughs and the arrangement of the flexible pipes serves to create a hanging double category curve on the upstream side of the trough between the floating support and the trough so as to avoid or reduce as much as possible the stresses and movements of the flexible pipes at their point of contact with the sea floor which would destructure the sea floor by creating trenches and would weaken the pipe because of the pipe being flexed in alternation in the region of the point of contact, thereby requiring its structure to be reinforced and/or requiring the sea floor to be protected. The stresses and movements at the point of contact between the flexible pipe and the sea floor are indeed reduced as a result of the stresses and the movements of the pipe being damped by the first flexible pipe portion in the form of a hanging double catenary that is created by causing the pipe to pass over said trough, the first portion being more involved in absorbing horizontal movements of the floating support than is the second flexible pipe portion in the shape of a single catenary.

When suspended from its two ends, a said undersea flexible line takes up under its own weight the shape of a hanging double catenary, as is known to the person skilled in the art, i.e. it goes down in a catenary configuration to a low point where its tangent is horizontal (see below), after which it rises up to said floating support, which hanging catenary can accommodate large amounts of movement between its ends, which movements are absorbed by deforming the flexible pipe, in particular in the rising or descending portions on either side of the low point of said hanging catenary.

It should be recalled that the flexible pipe portion between an end from which it is suspended and the low portion of horizontal tangent, specifically in said second flexible pipe portion the point of contact with the sea bottom, adopts a symmetrical curve as formed by a hanging pipe portion of uniform weight subjected to gravity, which curve is known as a "catenary" and is a mathematical function of the hyperbolic cosine type:

$$y=R_0(\cos h(x/R_0)^{-1})$$

$$R=R_0\cdot(Y/R_0+1)^2$$

where:

- x represents the distance in the horizontal direction between the horizontal tangency point and a point M on the curve;
- y represents the height to the point M (x and y are thus the abscissa and ordinate values of a point M on the curve relative to a rectangular frame of reference having its origin at said point of contact);
- $R_0$ represents the radius of curvature at said point of contact, i.e. the point with a horizontal tangent; and
- R represents the radius of curvature at the point M(x,y).

Thus, the curvature varies along the catenary from the top end where its radius of curvature has a maximum value Rmax to the point of contact with the sea floor where its radius of curvature has a minimum value Rmin (or R0 in the above formula). Under the effect of waves, wind, and current, the surface support moves laterally and vertically, thereby having the effect of raising or lowering the pipe of catenary shape where it touches the sea bottom.

For a bottom-to-surface connection in the form of a single catenary, the most critical portion of the catenary is situated in its portion close to the point of contact, and most of the forces in this bottom portion of the catenary are in fact generated by the movements of the floating support and by the excitations that are applied to the top portion of the catenary, which is subjected to current and to swell, with all of these excitations then propagating mechanically along the pipe to the bottom of the catenary.

The essential function of the first portion of the flexible pipe in the form of a hanging double catenary that is located upstream from the trough is thus more specifically to absorb, at least in part, the movements of the pipe and/or the movements of the floating support to which said flexible pipe is connected, by mechanically decoupling movement between respectively said floating support and said second flexible pipe portion in the form of a single catenary. However another function is also to reduce the traction forces exerted by said second flexible pipe portion on the undersea equipment and/or the end of the pipe resting on the sea bottom to which it is connected, as the case may be.

In the prior art, the intermediate support troughs for said flexible pipes are held in the subsurface at a certain depth by supporting floats from which each of the troughs is suspended. However those floats are subjected to large amounts of movement which means that sufficient distance must be provided between the various floats in order to ensure that they do not strike against one another.

Those constraints involve spreading out the working zone and limiting the number of flexible bottom-to-surface connections that can be connected to a common floating support, via its sides, in order to avoid interference between the various flexible connections and the various floats. That is why it is desired to provide an installation suitable for making it possible from a given floating support to use a plurality of flexible type bottom-to-surface connections, with reduced size and movement, and that is also as simple as possible to lay, being suitable for being fabricated at sea from a pipe laying ship.

WO 00/31372 and EP 0 251 488 describe pluralities of bottom-to-surface connections in which flexible pipes extend from a floating support to the bottom of the sea, passing via a rigid support supporting a plurality of troughs all arranged at the same height side by side with lateral offsets, said troughs being supported by a said support structure resting on the sea bottom or by a said support structure suspended from floats and connected by not more than two tension legs to a base anchored to the bottom of the sea. The top and bottom ends of the tension legs are connected to the support structure at the attachment points of the support structure and to the base at the respective attachment points thereof referred to as "top attachment points" and "bottom attachment points".

In the prior art, it is sought to minimize the number of tension legs between the trough support structure and the base at the sea bottom, so as to be left with no more than two top attachment points in alignment at the trough support structure and therefore no greater number of tension legs aligned in a generally vertical common plane at their top ends so as to obtain a mechanical connection that is isostatic. If three tension legs are used, maintaining an isostatic connection requires the three top attachment points of said tension legs that are parallel to one another and substantially vertical to be in an arrangement that is triangular, preferably an equilateral triangle, in a plane that is not a substantially vertical plane. The more said triangle becomes flattened, i.e. the more its vertex tends towards an angle of 180°, the more it moves towards a configuration of three points in alignment and the more it moves away from an isostatic configuration.

Mechanically, a configuration is said to be "isostatic" when the distribution of forces in said tension legs is unique and therefore computable in known manner. However, for three tension legs having top attachment points that are in alignment, and also for more than three tension legs, the mechanical system ceases to be isostatic and becomes statically undetermined, i.e. the distribution of forces in each of the tension legs cannot be calculated in unique manner. In this non-isostatic example, as for a four legged stool, the assembly may possibly become unstable, with some of the tension legs possibly carrying a greater fraction of the load, while others are less loaded or even in some cases completely slack, i.e. they carry no load.

In the above-described prior art, rupture of a tension leg, leads either to the destruction of the installation when there is only a single tension leg, or to dangerous unbalance of the trough support structure when there are two tension legs or when there are three tension legs arranged in a triangle in a plane that is not substantially vertical. This generally leads to the trough support structure tilting to a large extent or completely, thereby running the risk of irremediably damaging the flexible pipes or electric cables it supports and thus leading to partial or total destruction of the bottom-to-surface installation. In addition, for crude oil production lines, such incidents risk causing major pollution.

Such ruptures are particularly to be feared in installations where the depth of water is not very great, i.e. a few tens or even hundreds of meters, since at those depths, swell and current act on the entire depth of water and are thus particularly troublesome for a trough support structure fitted with its troughs and buoyancy elements. In addition, swell, wind, and currents also destabilize the floating support, and the resulting movements are transmitted via the flexible pipes to the submerged support structure and therefore have an effect on the tension legs and on their top and bottom attachment points. Thus, when the depth is not very great, i.e. up to a depth of 300 m and when ocean and weather conditions are dangerous, the flexible pipes, the trough carrier structure, and its connections to the foundation on the sea bottom are particularly subjected to forces that are considerable, or even extreme, thereby creating wear and fatigue, mainly at the ends of the tension legs and at their attachment points. Such accidents have already happened in the recent past.

A known but unsatisfactory solution for making a multiple tension leg system less statically undetermined consists in designing a trough support structure that presents great flexibility, i.e. that is able to bend considerably, which thus enables all of the tension legs to contribute, but with certain limits. The main drawback of that configuration lies in the problems of fatigue and wear that are to be feared at the tension legs and their attachment points, then being transferred to the support structure and thus potentially leading, in the event of an incident, to even worse damage.

BRIEF SUMMARY OF THE INVENTION

An aspect of the invention is supplying a system for anchoring said support structure in which maintenance operations that consist in changing any one of the tension legs can be performed without difficulty, without disturbing the operation of the device, and therefore without needing to disconnect the pipes and/or to stop oil production.

More particularly, the present invention is thus to provide an installation with a multiplicity of flexible pipe bottom-to-surface connections from a common floating support for troughs anchored to the sea bottom by a plurality of at least three tension legs in a manner that is firstly quasi or pseudo isostatic and, secondly, for which maintenance is as easy as possible.

Another aspect is to enable the various pipes to be fabricated and installed easily by sequential fabrication and laying from a laying ship on the surface; and to optimize the use of buoyancy and tensioning and anchoring means for the trough support structure in the event of installation being spread out in time over a long period between installing the various flexible bottom-to-surface connections, and without it being necessary to have prior knowledge of the number of connections that are to be laid, nor of their characteristics in terms of dimensions and unit weight.

During a stage of designing the development of an oil field, the oil deposit is known incompletely, so production at full rate often makes it necessary, after a few years, to revise initial production plans and the organization of the associated equipment. Thus, during initial installation of the system, the number of bottom-to-surface connections and the way they are organized is defined relative to estimated needs, which needs are almost always revised upwards once the field is put into production, either for recovering crude oil, or because it is necessary to inject more water into the deposit, or indeed because it is necessary to recover or to reinject more gas. As the deposit becomes depleted, it is generally necessary to drill new wells and to inject water or gas, or indeed to drill production wells at new locations on the field so as to increase the overall recovery rate, thereby correspondingly complicating the set of bottom-to-surface connections connected to the side of the FPSO.

Another aspect of the present invention is also to provide an installation of flexible bottom-to-surface connections of great strength and at low cost, in which the methods for fabricating and installing and maintaining the various component elements are simplified and also of low cost, and can be performed at sea from a laying ship.

To do this, the present invention relates to a device comprising a rigid structure held immersed in the subsurface by floats and anchored to the bottom of the sea by tension legs, for the purpose of supporting a plurality of arch-shaped support and guide elements, referred to as "troughs", in a bottom-to-surface connection installation between a single floating support and the bottom of the sea, the installation having a plurality of flexible lines comprising flexible pipes extending to the bottom of the sea where they are connected to wellheads, to equipment, or to the ends of undersea pipes resting on the sea bottom, said flexible lines being supported respectively by said plurality of troughs.

Said trough support structure is connected to a base resting on and/or anchored to the sea bottom by a plurality of n tension legs tensioned substantially in parallel, preferably substantially vertically, by said float, where n is not less than three, each of a plurality of p said tension legs from the n tension legs, where p is not less than (n−2), being connected at one of its ends to a distance-varying device secured to said base or to said support structure, said distance-varying device being connected to said base or to said support structure or being integral with said base or said support structure, the other end of said tension leg being fastened to an attachment point secured to said support structure or respectively to said base, said distance-varying device being suitable for being actuated to vary the distance between its attachment point to said tension leg and said base or said support structure to which it is fastened or connected.

More particularly, and preferably, the top end of said tension leg is fastened at a top attachment point secured to said support structure or respectively to said distance-varying device, the bottom end of said tension leg being fastened at a bottom attachment point secured to said distance-varying device or respectively to said base, said distance-varying device being suitable for:

- varying the distance between said top attachment point and said support structure when said distance-varying device is secured to said support structure; or
- varying the distance between a said bottom attachment point and said base when said distance-varying device is secured to said base.

It can be understood that under all circumstances, the distance-varying device of the invention enables the distance between said support structure and said base to be varied.

It can also be understood that said distance-varying device, when it is secured to said structure, is fastened to said support structure via its underside, and when it is secured to said base, said distance-varying device is fastened to the top surface of said base.

It can be understood that decreasing or increasing the distance between said support structure and said base, as a result of actuating said distance-varying device, leads to an increase, or respectively to a decrease, in the tension of said tension leg. Furthermore, increasing the tension of said tension leg can lead to an increase in the length of said tension leg in proportion to the tension, but in practice such elongation is less than 1%.

Under such circumstances, it can be understood that the variation in the distance between said support structure and said base is substantially identical to the variation of the distance between the bottom (or top) attachment point and said base (or respectively said support structure), the difference resulting from variation in the length of the tension leg as a result of the tension in said tension leg increases as a result of the distance between said base and said support structure decreasing. More precisely, under such circumstances, the variation in the distance between said base and said support structure is slightly greater than the variation in the distance between said bottom (or top) attachment point and said base (or respectively said support structure) as a result of the tension leg lengthening.

It is thus possible at will and while in operation to configure the distribution of loads taken up by the various tension legs as a function of the loads supported by said support structure via the various troughs, by adjusting the tensions in said tension legs by using said distance-varying devices. The distance-varying devices then make it possible to make the system quasi-isostatic, and where appropriate enable the load on each of the tension legs to be distributed in controlled manner.

Furthermore, a distance-varying device serves to facilitate maintenance and replacing a tension leg should that be necessary by reducing its tension as much as necessary.

In practice, for tension legs having a length lying in the range 10 meters (m) to 150 m, when the support structure is immersed at a depth of 200 m to 3000 m, the distance-varying device serves to adjust the distance between the top and bottom attachment points over the range 0 to 3 m, and preferably over the range 0 to 1.5 m, which suffices to adjust the tensions as a function of the re-balancing needed, depending on the loads created by said flexible lines or pipes at the troughs.

It can be understood that said distance-varying device may be secured (i) to said support structure, such that said top attachment point is secured to the distance-varying device, or else (ii), and preferably, it can be secured to said base on the sea bottom, such that said bottom attachment point is secured to the distance-varying device.

Preferably, said top attachment points of said p tension legs are arranged at said support structure and said bottom attachment points of said p tension legs are arranged at said distance-varying devices, said distance-varying devices being secured to said base, preferably being fastened to the top surface of said base, and each said distance-varying device serves to vary the distance between said bottom attachment point and said base.

It is easier to take action on a distance-varying device, whether for actuating it or for handling it, when the device is fastened on the base, since it is then more disengaged, in particular for handling by using an undersea robot as described below, as compared with when it is positioned on the underside of the support structure, given the space occupied by the multiplicity of flexible lines and pipes passing via the troughs. Under such circumstances, the distance-varying device is a distance-varying device between said bottom attachment point and said base.

In known manner, a said tension leg is constituted by a cable or a chain or indeed by a rigid bar hinged at its ends. Preferably, said tension leg that is connected to a said distance-varying device is a single cable or chain.

Where appropriate, two tension legs that are not connected to a said distance-varying device are situated at two opposite longitudinal ends of the support structure, preferably with their two corresponding top attachment points arranged along a diagonal. In the event of three tension legs not being connected to a said distance-varying device, the top attachment points of said three tension legs lie in a substantially horizontal plane forming a triangle, preferably as close as possible to an equilateral triangle.

Preferably, all of the tension legs are connected to a said distance-varying device.

FR 2 954 966 describes a device having a rigid support structure for a plurality of troughs of the above-described type, said structure being anchored by a plurality of anchor lines having top attachment points arranged in pairs in four zones of the structure, the four zones being arranged in a trapezoid. If one pair of tension legs at one of the corners of the trapezoid fails, then the other tension legs are no longer certain to be capable of ensuring that the structure is stable under all circumstances, like an unstable tripod, as explained below.

An object of the present invention is thus to provide an improved installation for a large quantity of flexible bottom-to-surface connections making it possible to connect a floating support to a plurality of wellheads and/or undersea installations installed on the bottom of the sea, the installation including an immersed trough-support structure that is anchored to the sea bottom by a plurality of tension legs, and overcoming the above-mentioned drawbacks.

To do this, the present invention provides a device comprising a rigid structure held immersed in the subsurface by floats and anchored to the bottom of the sea by tension legs, for the purpose of supporting a plurality of arch-shaped support and guide elements, referred to as "troughs" in a bottom-to-surface connection installation between a single floating support and the bottom of the sea, the installation having a plurality of flexible lines comprising flexible pipes extending to the bottom of the sea where they are connected to wellheads, to equipment, or to the ends of undersea pipes resting on the sea bottom, said flexible lines being supported respectively by said plurality of troughs, in which device:

said trough support structure is connected to a base resting on and/or anchored to the sea bottom by a plurality of n tension legs tensioned substantially in parallel, preferably substantially vertically, by said float, where n is not less than six, each of a plurality of p said tension legs from the n tension legs, where p is not less than (n−2), being connected at one of its ends to a distance-varying device, said distance-varying device being connected to said base or to said support structure or being integral with said base or said support structure, the other end of said tension leg being fastened to an attachment point secured to said support structure or respectively to said base, said distance-varying device being suitable for being actuated to vary the distance between its attachment point to said tension leg and said base or said support structure to which it is fastened or connected; and the top end of said tension leg is fastened at a top attachment point secured to said support structure or respectively to said distance-varying device, the bottom end of said tension leg being fastened at a bottom attachment point secured to said distance-varying device or respectively to said base, said distance-varying device being suitable for:

varying the distance between said top attachment point and said support structure when said distance-varying device is secured to said support structure; or varying the distance between a said bottom attachment point and said base when said distance-varying device is secured to said base;

the device being characterized in that it includes at least six top attachment points, having at least three first top attachment points lying on a circle (C), the at least three other top attachment points being arranged on or inside said circle (C).

Preferably, said support structure presents a longitudinal shape of substantially rectangular horizontal section, and the at least three said first top attachment points are arranged in the proximity of each of the longitudinal ends of said support structure.

It can thus be understood that two of said attachment points are arranged in the proximity of a first longitudinal end, with the other said attachment point being arranged beside the opposite longitudinal end of said support structure.

It can be understood that all of said top attachment points are distributed, half on one side of a diameter of said circle and the other half on the other side of said diameter, so that the resultant of the tensions exerted by said tension legs via said top attachment points on said rigid structure is preferably applied at the proximity of the center of gravity of said rigid structure, which corresponds substantially to the center of said circle.

Preferably, all of said top attachment points are distributed so as to be arranged symmetrically relative to the center of said circle.

More particularly, at least two of said top attachment points are diametrically opposite and are arranged respectively in the proximity of each of the opposite longitudinal ends of said support structure.

Still more particularly, said top attachment points of the present invention are arranged and spaced apart in a horizontal section plane of said structure so that at least two top attachment points lying on said circle (C) are located respectively in the proximity of each of the opposite longitudinal ends of said support structure, and at least two of said top attachment points lying on the circle (C) are arranged respectively in the proximity of each of the opposite transverse ends of said support structure, said transverse direction being the direction perpendicular to the longitudinal direction of said support structure in said horizontal section plane.

Still more particularly, when there are only three top attachment points lying on a said circle, they are preferably arranged so as to form an isosceles triangle.

More particularly, said support structure presents a longitudinal shape of substantially rectangular horizontal section, that is preferably substantially symmetrical about a longitudinal vertical midplane (YZ), the device having at least six tension legs, each connected to a said distance-varying device, and said support structure has at least six said top attachment points, with four of the top attachment points defining the four corners of a rectangle, the other two top attachment points being arranged inside a circle (C) that circumscribes said rectangle, preferably at or in the vicinity of two long sides of the rectangle, more preferably at the transverse middle axis (XX') of said rectangle, the four corner attachment points being arranged in the proximity of the longitudinal ends of said support structure.

This form of support structure is more practical for supporting a plurality of troughs arranged in parallel so as to be laterally juxtaposed and in succession in said longitudinal direction. In this configuration, even when one tension leg ruptures, the other five tension legs arranged in a trapezoid serves to stabilize the support structure until said tension leg for replacing has been replaced. In contrast, with only five tension legs in a trapezoid configuration, it is no longer certain that the stability of the support structure can be maintained under all circumstances in the event of one tension leg rupturing so that only four tension legs remain under tension, since, in certain configurations, the trapezoid transforms into a triangle of unstable type.

In an embodiment, said support structure comprises two portions that are hinged to pivot about a pivot axis ($X1X'_1$) that is substantially horizontal, and preferably in the middle, suitable for allowing each of said two hinged portions to pivot relative to the other through an angle of −10° to +10°, preferably of −5° to +5°, said pivoting being limited by top abutments and bottom abutments of each of said two hinged support structure portions, said two hinged support structure portions preferably being symmetrical about a vertical midplane containing said pivot axis ($X1X'_1$), each of said two hinged portions being connected to said base by at least three said tension legs, of which at least one, and preferably all three, is/are connected at one of its/their ends to a distance-varying device.

More particularly, each said hinged portion of said support structure presents a longitudinal shape of substantially rectangular horizontal section, preferably substantially symmetrical about a longitudinal vertical midplane (YZ), the device having at least six tension legs, each connected to a said distance-varying device, and said support structure has at least six top attachment points, each said hinged portion of said support structure comprising at least:

- two top attachment points arranged at the longitudinal ends of each said hinged portion that are further from said pivot axis ($X1X'_1$); and
- one top attachment point arranged closer to said axis of rotation than a said longitudinal end.

Still more particularly, the top attachment points of said first hinged support structure portion are arranged symmetrically to the three top attachment points of the second hinged support structure portion about the substantially vertical plane containing said pivot axis, preferably as an isosceles triangle.

This embodiment in two hinged portions is particularly advantageous for support structures of very large dimensions, since it reduces the stiffness of the assembly and makes it easier to adjust the tensions in the tension legs because of the relative independence between the tension legs for each of the two half-structures.

The distance-varying device may be a cable system with a said attachment point at its end co-operating with drums, pulleys, and/or winches, or is preferably a device of the linear actuator type of variable length, preferably of the mechanical or hydraulic actuator type.

In a preferred embodiment, the device of the invention includes at least one said distance-varying device comprising an actuator, preferably an actuator that is mechanical or hydraulic.

It is advantageous to use a hydraulic actuator since that makes it possible to correlate the tension of said tension leg with the hydraulic pressure inside the cylinder of the actuator as indicated by a pressure gauge or preferably a pressure sensor at an orifice of the actuator cylinder.

More particularly, said bottom attachment point is secured to the movable rod of said hydraulic actuator having its actuator cylinder secured to the base.

It can be understood that retracting the rod of the actuator serves to shorten the distance between the bottom attachment point and said base, and thus to increase the tension of said tension leg, while extending the rod of the actuator serves to increase the distance between said bottom attachment point and said base, and thus to decrease the tension of said tension leg.

In a preferred embodiment, said actuator includes a pressure gauge or preferably a pressure sensor at an orifice of the actuator cylinder, and a locking device suitable for locking the rod in position, preferably by closing the actuator chamber in leaktight manner.

Also preferably, said hydraulic actuator is connected or suitable for being connected to a pressurized fluid feeder unit on board an undersea robot, preferably under control from a second vessel on the surface.

More particularly, said support structure supports five to 12 arch-shaped troughs having a radius of curvature in the range 1.5 m to 3 m, said support structure having a width lying in the range 3 m to 5 m, and a length lying in the range 10 m to 30 m, and dead weight in air lying in the range 30 metric tonnes (t) to 50 t, and said support structure has buoyancy incorporated under the troughs so that each said tension leg is subjected to tension lying in the range 0.5 t to 10 t, preferably in the range 1 t to 5 t, said tension leg being dimensioned to be suitable for supporting a tension that is two to four times said tension to which it is subjected.

Still more particularly, said support structure is a metal lattice structure extending longitudinally in a horizontal direction.

Still more particularly, said rigid support structure is suspended from at least one immersed top float to which it is connected by flexible connection elements such as slings, and/or preferably said support structure is supported by at least one incorporated bottom float to which it is fastened.

Still more particularly, said support structure supports a plurality of troughs, preferably at least five troughs that are laterally offset in parallel in one direction (YY') of said support structure, said trough being arch-shaped and preferably arranged symmetrically about a vertical longitudinal axial plane (YZ) of said support structure.

According to other advantageous characteristics:

a said flexible pipe is held in a said trough by retaining and/or attachment means; and the troughs supported by a given rigid support structure are arranged at different heights; and the ends of the troughs that it supports include respective deflectors of profile adapted to avoid damaging the flexible pipe portion that might come into contact with a said deflector while the pipe is being laid on a said trough.

The present invention also provides a bottom-to-surface connection installation between a single floating support and the sea bottom, the installation comprising a plurality of flexible lines comprising flexible pipes extending from said floating support to the sea bottom, where they are connected to wellheads, to equipment, or to the ends of undersea pipes resting on the sea bottom, said flexible lines being supported respectively by a said plurality of troughs, each defining two pipe portions comprising a first flexible line portion in a hanging double catenary configuration between the floating support and said trough, and a second flexible line portion in a single catenary configuration between said trough and the point of contact of the flexible pipe with the sea bottom, said trough being supported by a trough support device of the invention.

The present invention also provides a method of modifying the tensions to which various said tension legs of a support device of the invention is subjected, the method being characterized in that at least one said distance-varying device is actuated so as to adjust the tension of said tension leg to which it is connected to have a desired controlled value.

The present invention also provides a method of the invention, characterized in that the tension of a said tension leg is decreased by actuating said distance-varying device to which it is connected, and then the tension leg is replaced.

The present invention also provides a method of the invention, characterized in that the mechanical connection between the various tension legs and said support structure is made mechanically quasi-isostatic by actuating at least one said distance-varying device.

The term "quasi-isostatic" is used herein, in conventional manner, to designate the fact that the tension in each of the tension legs is known and that during movements of the trough support structure under the effects of swell, current, and movements of the floating support, said trough support structure moves substantially in a horizontal plane with the tension in each of said tension legs varying in known manner and within limits set by the overall geometry of said tension legs, which are preferably mutually parallel.

BRIEF DESCRIPTION OF THE SEVERAL VIEWS OF DRAWINGS

Other characteristics and advantages of the present invention appear in the light of the following detailed description given with reference to the following figures, in which:

FIG. 1 is a side view of a bottom-to-surface connection installation of the invention between a floating support 2 that is anchored at 2*b*, and a metal support structure 5 supporting a plurality of arch-shaped troughs 4 that are anchored to a base 8 resting on the sea bottom 3, via a plurality of tension legs 7;

FIG. 2A is a side view of a prior art installation in which a single flexible pipe 1 rests on a single arch-shaped trough 4 that is anchored by a single tension leg 7 terminating at its top end in a bridle 7*c* so that the tension leg is attached to the trough via two top attachment points 7*a*, a buoyancy element being situated above the trough and connected thereto;

FIG. 2B is a front view of a prior art installation comprising a support structure with three troughs, said structure being anchored by two tension legs and being fitted with a single float;

FIG. 3A is a front view in the YZ plane of an installation of the invention comprising a support structure 5 secured to a plurality of floats 6*a* incorporated in said structure and supporting a plurality of troughs, specifically six troughs 4*a* to 4*f*, said structure being anchored by six tension legs 7 attached at six top attachment points 7*a*1 to 7*a*6;

FIGS. 3B and 3C are views of the support structure 5 as seen from beneath in horizontal section (XY plane) corresponding to the structure of FIG. 3A and showing the arrangement within a rectangle of the six top attachment points 7*a*1 to 7*a*6 of the six tension legs;

FIGS. 3D and 3E are two views from beneath of the support structure 5 in horizontal section (XY plane) showing two top attachment points 7*a*3-7*a*4 situated overhanging from the support structure 5, three or four top attachment points (FIG. 3A or FIG. 3B) lying on a circle (C), while the other top attachment points are situated inside the circle C;

FIG. 4A is a side view in the XZ plane of FIG. 3A showing details of buoyancy elements 6*a* constituted by caissons of prismatic or rectangular type section in the XZ plane that are incorporated in the support structure 5 beneath the troughs, said caissons being filled with solid, liquid, or gaseous compounds that are lighter than sea water;

FIG. 4B is a side view of FIG. 3A showing details of buoyancy elements 6*a* constituted by caissons of cylindrical type with circular section in the XZ plane and incorporated in the trough carrier structure;

Figure 7A:
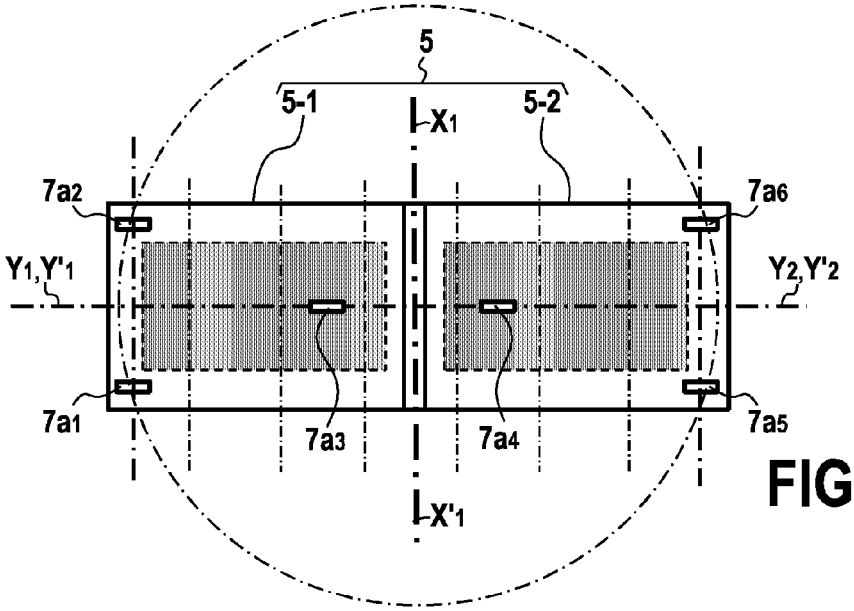
Figure 7B:
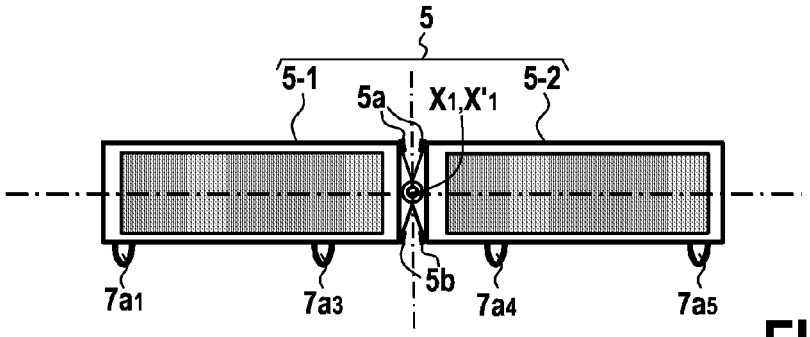
Figure 7C:
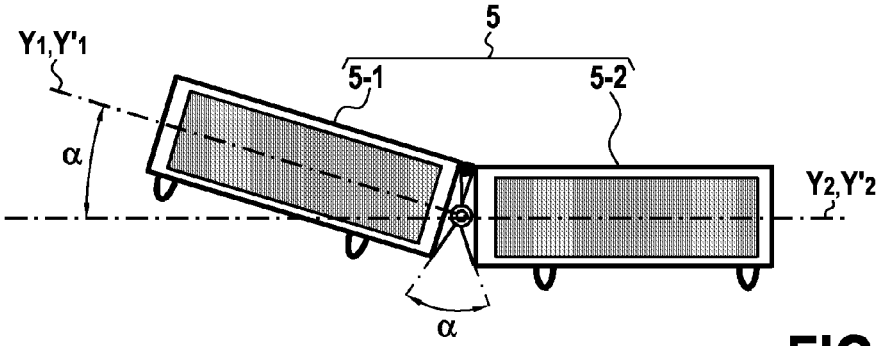

FIG. 5 is a side view of an installation showing a common base 8 having two distance-varying devices 10 for individually adjusting the length of each of two tension legs 7-1, 7-2 attached to bottom attachment points 7*b*1, 7*b*2 at the rod 10*b* of an actuator of the invention;

FIG. 6 shows a variant embodiment of a distance-varying device 10 comprising an actuator having a hydraulic pressure gauge or sensor 11*a* for the actuator of the invention; and FIGS. 7A to 7C show an embodiment in which said support structure 5 comprises two portions 5-1, 5-2 hinged to point about a middle axis X1X'1.

DETAILED DESCRIPTION OF THE INVENTION

Figure 1:
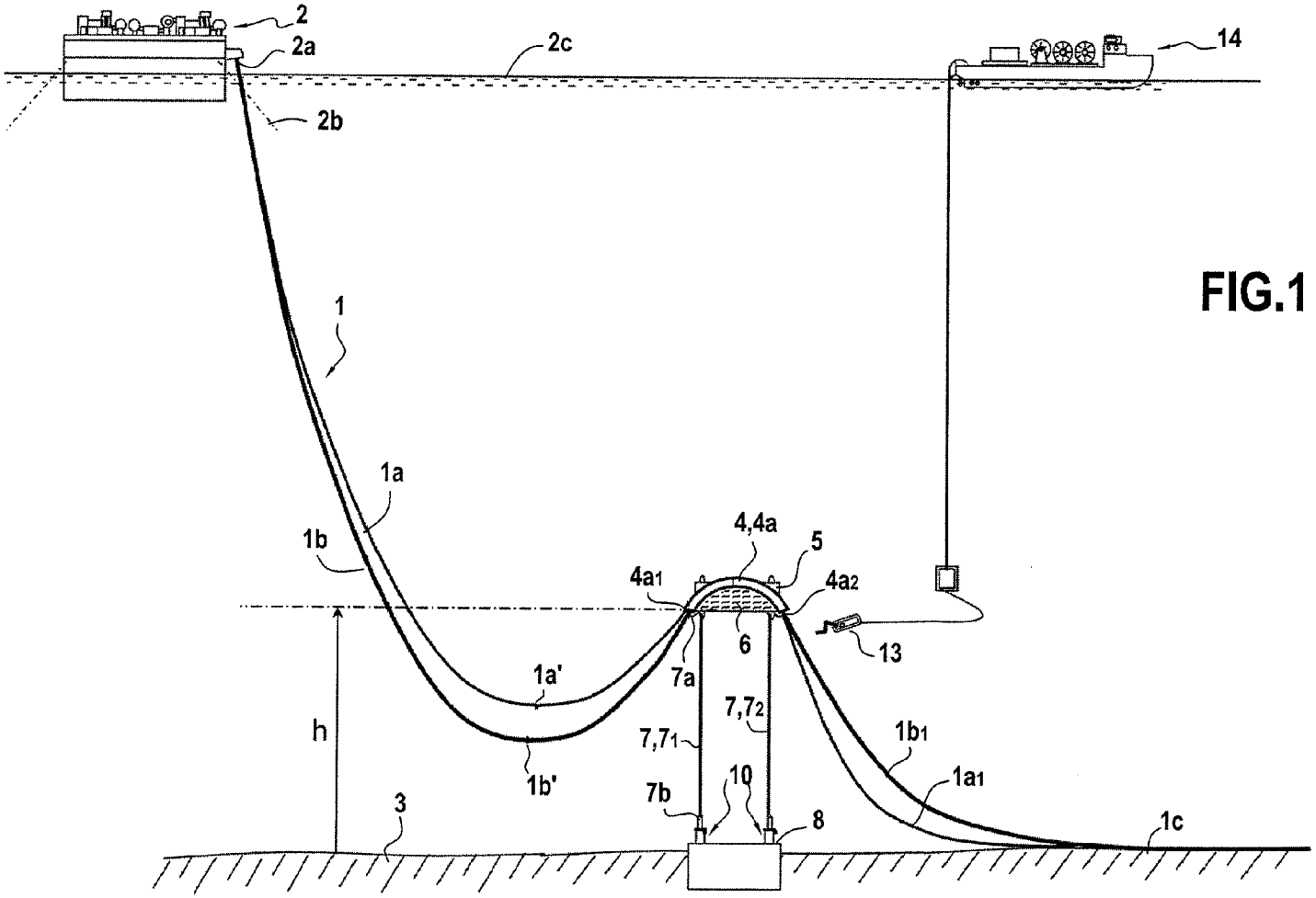

FIG. 1 shows a bottom-to-surface connection installation comprising two flexible pipes or electric cables 1*a*, 1*b* connected at one end 2*a* to a floating support 2 that is held in position by anchor lines 2*b*, the other ends of said flexible pipes resting on the sea bottom 3 substantially at 1*c*. The double catenaries flexible pipes 1*a*, 1*b* are in a hanging catenary configuration going down from the floating support 2 to respective horizontal tangency points 1*a*', 1*b*', and then in a rising catenary configuration up to the entry 4*a*1 of respective trough 4*a* and 4*b*, of radius of curvature R greater than the minimum acceptable radius of curvature for said flexible pipes or said cables. Thus, the flexible pipe 1*a* enters the trough 4*a* at 4*a*1, then rests on said trough, and then leaves it at 4*a*2 in order to go down to the sea floor 3 substantially at 1*c* in a single catenary configuration 1*a*1. Each of the troughs 4*a*, 4*b*, etc. is positioned to be laterally offset relative to the others on the support structure 5, as shown in FIGS. 2B and 3A. In general, the troughs in a given installation all have the same radius of curvature and they are secured to one another by means of said support structure 5. Said structure has buoyancy elements 6*a* that may either be incorporated in said support structure 5, or else be external, generally in the form of floats 6*b* situated above said structure and connected thereto by means of respective single tension legs 6*c*1, as shown in FIG. 2A, or by means of a bridle 6*c*2, as shown in FIG. 2B.

The support structure 5 is maintained substantially at an altitude h above the sea bottom by a plurality of tension legs 7 that are connected at their top ends via top attachment points 7*a* to said support structure 5, and at their bottom ends via bottom attachment points 7*b* to a base 8 resting on the sea bottom 3, e.g. a weight base, or indeed a suction anchor embedded in the sea bed and referred to below as a "foundation".

Figure 2A:
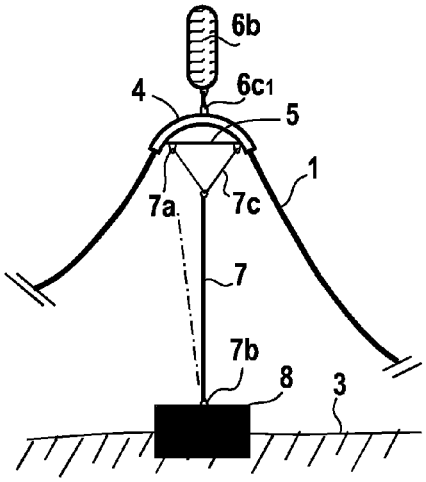
Figure 2B:
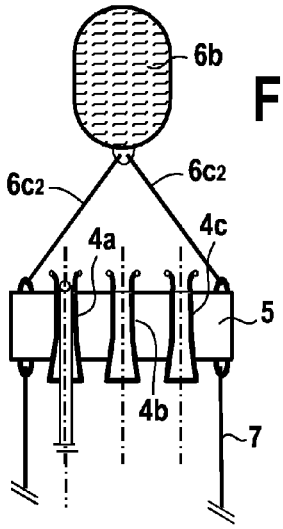
Figure 3A:
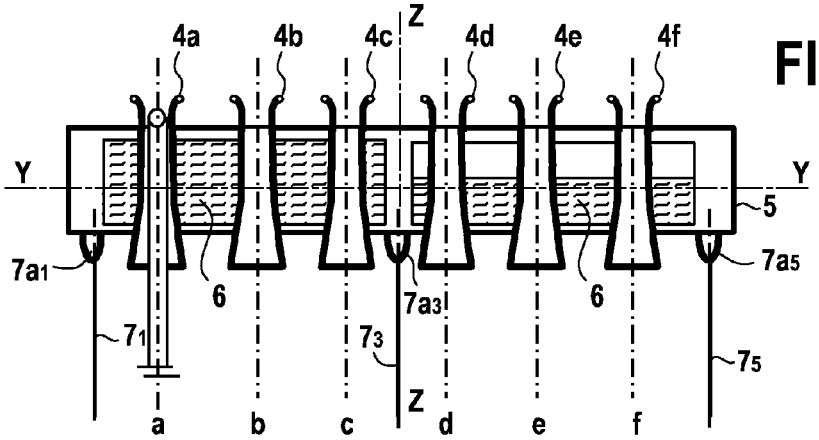

In the prior art, as shown in FIGS. 2A and 2B, it is generally sought to minimize the number of tension legs between the support structure 5 and the base 8. Thus, for a singe flexible pipe 1, as shown in FIG. 2A, a single tension leg 7 is used, possibly connected to said support structure 5 via a bridle 7*c*, said tension leg then being in the same vertical plane as said flexible pipe. Likewise, for a plurality of flexible pipes or electric cables arranged on a plurality of three troughs 4*a* to 4*c* that are laterally juxtaposed, as shown in FIG. 2B, the support structure 5 is connected to its base 8 by means of two tension legs, possibly connected to said support structure 5 via respective bridles (not shown).

These two means for anchoring the support structure 5 are generally preferred since they serve to minimize the number of tension legs, and thus overall costs, and furthermore each of them performs anchoring in an isostatic mode. In order to remain isostatic, it is possible in the configuration shown in FIG. 2B to envisage using three tension legs, however in order to retain this overall isostatic characteristic, it is appropriate for the attachment points of said tension legs not to be in alignment but rather to be in a triangular configuration, in any plane that is not a vertical plane.

Thus, in the above-described prior art, the rupture of a tension leg either leads to destruction of the installation as in the example of FIG. 2A where there is only one tension leg, or else leads to dangerous unbalance of the support structure 5 when there are two tension legs as shown in FIG. 2B, or when there are three tension legs arranged in a triangle in a plane that is substantially vertical. This generally leads to the support structure 5 tilting to a large extent or completely, thereby running the risk of irremediably damaging the flexible pipes or electric cables and thus leading to partial or total destruction of the bottom-to-surface installation. With a single tension leg, the support structure 5 is then completely free to move upwards and in all directions without any control being possible. In addition, when such incidents involve crude oil production lines, they run the risk of leading to major pollution.

Such ruptures are particularly to be feared in installations where the depth of water is not very great, i.e. a few tens to a few hundreds of meters, since at such depths, swell and current act throughout the depth of water and they are particularly dangerous for the support structure 5 with its troughs and its buoyancy elements. Furthermore, swell, wind, and current also destabilize the floating support, and the resulting movements are transferred by the flexible pipes to the support structure 5 and thus to the tension legs 7 and to their top and bottom attachment points 7*a* and 7*b*. Thus, when the depth is not very great, i.e. a depth in the range 25 m to 300 m, and when ocean and weather conditions are severe, the hoses, the trough carrier structure, and its connections with the foundation are subjected to particularly large forces that can become extreme, leading to wear and fatigue, mainly at the ends of the tension legs and at their attachment points. Such accidents have already occurred in the recent past.

Figure 3B:
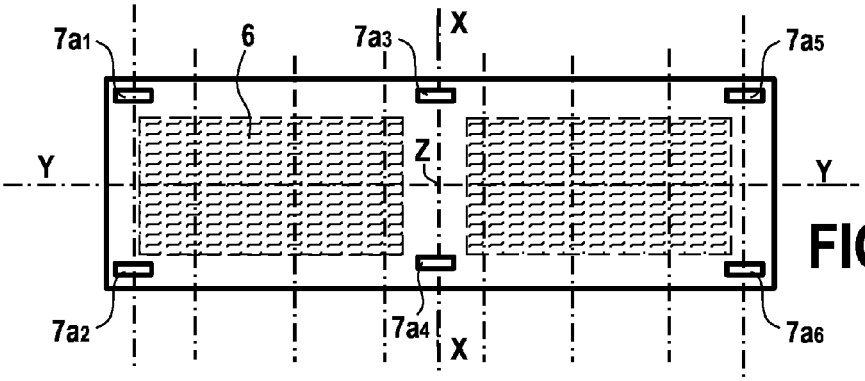

In order to avoid the consequences of a tension leg rupturing, or of one of its attachment points rupturing, the device of the invention advantageously anchors the support structure 5 by means of at least six tension legs that are preferably distributed symmetrically about the axis YY of said support structure 5, as seen from beneath in particular FIG. 3B. Each of the top attachment points 7*a*1-7*a*2-7*a*3-7*a*4-7*a*5-7*a*6 of the structure is connected to the corresponding respective bottom attachment point (not shown) 7*b*1-7*b*2-7*b*3-7*b*4-7*b*5-7*b*6 via a respective tension leg $7_1$-$7_2$-$7_3$-$7_4$-$7_5$-$7_6$, with all of the tension legs preferably being mutually parallel and vertical.

FIG. 5 shows the bottom attachment points 7*b*1-7*b*2 together with the tension legs $7_1$-$7_2$, said bottom attachment points being secured, in accordance with the invention, to the foundation 8, not directly but via a respective distance-varying device 10 serving for adjusting the distance L, i.e. the respective distances $L_1$-$L_2$, of said bottom attachment point from said foundation 8. A rigid support structure 5 anchored via two tension legs connected to the foundation, or indeed three tension legs providing the three top attachment points 7*a* of said tension legs are not in alignment, nor situated in a common vertical plane, presents a mechanical configuration that is said to be "isostatic", i.e. the distribution of forces in said tension leg is unique and can thus be calculated in known manner, in particular as a function of the distribution of the loads supported by the support structure 5 and the buoyancy elements incorporated in said structure. In contrast, when three tension legs have top attachment points that are in alignment, and also when there are more than three tension legs, the system becomes statically undetermined, i.e. the distribution of forces among the tension legs can no longer be calculated in unique manner. In a statically undetermined situation, as with a four-legged stool, the system can wobble and some of the tension legs might be subjected to a major fraction of the load while others are relatively lightly loaded, and indeed in certain situations completely slack, i.e. they transfer no load at all.

One solution for reducing the statically undetermined nature of the system having multiple tension legs consists in designing a support structure 5 that is very flexible, i.e. that can deform to a large extent, thereby enabling all of the tension legs to contribute, but only within certain limits. The main drawback of such a configuration lies in the problems of fatigue and wear that are already expected in the tension legs and their attachment points, then become transferred to the support structure 5 where, in the event of an incident, they can lead to even greater damage.

In order to restore a pseudo- or quasi-isostatic nature, i.e. in order to reduce the extent to which a system having multiple tension legs is statically undetermined, it is advantageous to install on the tension legs, and preferably on all of them, respective distance-varying devices 10 of the invention, each of which is suitable for adjusting the distance between its top attachment point 7*a* to the support structure 5 and its bottom attachment point to the foundation 8.

Figure 3C:
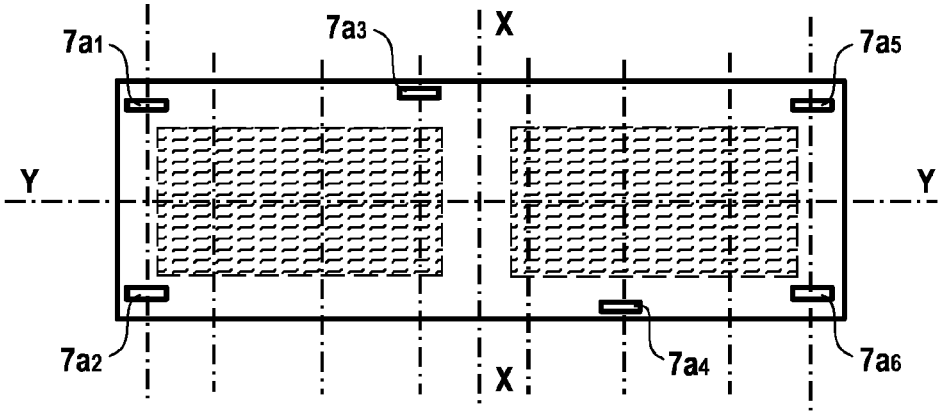
Figure 3D:
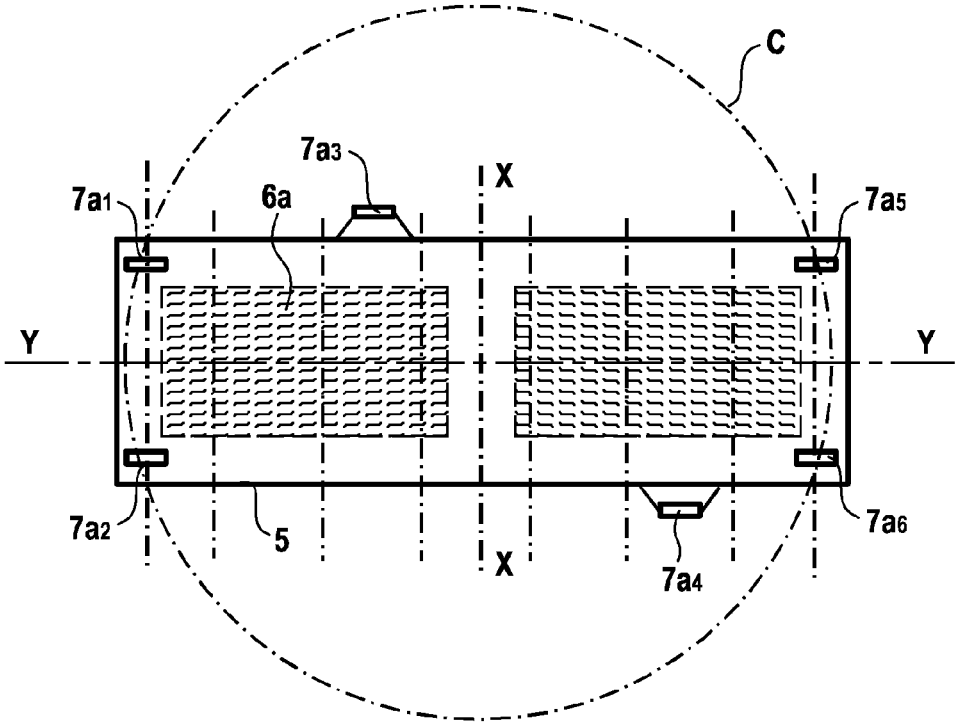

FIGS. 3 to 6 show side views of a device for restoring a quasi-isostatic nature to the overall device for anchoring the support structure 5 to the base 8, regardless of the number of tension legs 7, i.e. three tension legs when there is only one row of tension legs situated in a common longitudinal vertical midplane of the support structure 5, or preferably six tension legs arranged in a rectangle, as when there are two parallel rows of three tension legs substantially in alignment in a common substantially vertical plane arranged respectively on the long sides of the rectangle 4 with four top attachment points at the four corners of the rectangle, as shown in FIGS. 3B, 3C, and 3D.

In FIG. 3B, the two intermediate top attachment points 7*a*3 and 7*a*4 are arranged on the middle transverse axis XX of the support structure 5, while in FIG. 3C, the two intermediate top attachment points 7*a*3 and 7*a*4 are offset on either side of the middle transverse axis XX of the support structure 5.

In FIGS. 3D and 3E, two intermediate top attachment points 7*a*3 and 7*a*4 are offset on either side of the middle transverse axis XX of the structure and they are also offset along XX to lie outside the long side of the rectangle, so that they are no longer attached to said support structure 5, but to an overhang. In FIG. 3E, a short side of the rectangle lies between two corner top attachment points 7*a*1, 7*a*2, with the opposite side of the rectangle in the longitudinal direction having only one top attachment point 7*a*6 in a middle position. Under all circumstances, all of the top attachment points of the tension legs then lie on or inside a circle C circumscribing the rectangle formed by the four top attachment points 7*a*1, 7*a*2, 7*a*5, and 7*a*6 that the four corners (FIG. 3D), or the circle circumscribing the triangle formed by the three top attachment points 7*a*1, 7*a*2, and 7*a*6 (FIG. 3E).

Thus, a non-symmetrical configuration as shown in FIG. 3C, 3D, or 3E is advantageously suitable in certain situations where the flexible pipes are of different sizes, i.e. where there are differences between the vertical forces induced by those pipes and their respective locations on said support structure 5 and in the distribution of the buoyancy elements.

The term "quasi-isostatic" is used herein to mean that all of the tension legs co-operate in taking up the tension created by the upwardly-directed result out buoyancy, and each of said tension legs takes up substantially a known and adjustable percentage of said overall tension.

The quasi-isostatic adjustment and distance-varying device 10 of the invention acts on each of the tension legs of the device in individual manner to adjust the distance between the base 8 and the support structure 5, thereby distributing the unit loads in each of said tension legs in fully controlled manner, and thus making the device quasi-isostatic.

To do this, the altitude L of the bottom attachment point 7*b* of the tension leg 7 above the foundation 8 can be adjusted by the distance-varying device 10, which is shown in this example as being a hydraulic actuator with a rod that can be blocked mechanically, as is known to the person skilled in the art. Said distance-varying device 10 of the invention is constituted by an actuator cylinder or body 10*a* secured to the base and by an actuator rod 10*b* having its top end constituting the bottom attachment point 7*b* of the tension leg 7. The axis of said actuator cylinder or body 10*a*-10*b* is preferably vertical. The actuator cylinder or body 10*a* has an orifice 11 enabling said actuator cylinder or body to be connected via a duct to a hydraulic unit (not shown) available on board an automatic undersea remotely operable vehicle (ROV) 13 that is controlled from an installation ship 14 on the surface. Thus, by pressurizing the actuator, the actuator rod is forced to retract lengthwise in a downward direction, and this serves to adjust and shorten the distance between the base 8 and the support structure 5, and thus to shorten lengths, thereby having the effect of increasing tension in the corresponding tension leg. By acting in succession on each of the tension legs, the load taken up by each of the tension legs can thus be distributed in advantageous and in fully controlled manner, thereby enabling the assembly to be made "quasi-isostatic".

When force is applied to the actuator by increasing the pressure P of the fluid in the actuator, its rod retracts, and the tension in the corresponding tension leg increases. Thus, the percentage of the overall force taken up by said tension leg increases, and in general the other tension legs see their tensions decrease a little.

Likewise, when the pressure P of the fluid in the actuator is reduced, the rod of the actuator extends and the tension in the corresponding tension leg decreases, so that the percentage of the overall force taken up by said tension leg decreases, and in general the other tension legs see their tensions increase a little.

Thus, increasing or decreasing the pressure in a said actuator serves to adjust the distance between the foundation 8 and the top attachment point 7*a* in each of the tension legs and in individual manner, thereby adjusting the percentage of the overall tension T that is taken up individually by said tension leg. When adjustment has been completed, a position locking device 12 for locking the position of the rod 10*b* of the actuator is itself actuated, and then the pressure in the actuator is released and the hydraulic feed hose is disconnected. On the right of FIG. 5, there can be seen the distance-varying device 10 acting on the tension leg $\mathbf{7}_2$ in a locked position at an altitude corresponding to a distance L2, and on the left there can be seen the distance-varying device 10 relating to the tension leg $\mathbf{7}_1$, which is shown while adjusting an altitude corresponding to the distance L1, the ROV 13 (an automatic submarine controlled from the surface) connected by the duct of hydraulic circuit 13*a* to the pressure feed orifice 11 being in the process of adjusting the pressure P in the actuator, and thus of adjusting the tension in said tension leg $\mathbf{7}_1$. During this adjustment, the locking device 12 is held in the open position, and as a result the actuator is free to move in a lengthening or a shortening direction.

For reasons of symmetry, it is generally preferred to fit each of the tension legs 7 with its own distance-varying device 10. Nevertheless, when there are n tension legs, it may suffice to have n−2 distance-varying devices 10. The two non-adjustable tension legs, that are preferably situated at opposite longitudinal ends of the support structure 5, then define the substantially horizontal reference axis for anchoring the support structure 5 relative to the base 8, and adjusting each of the other tension legs then makes it possible to make the system quasi-isostatic, and thus enable the load on each of the tension legs to be distributed in controlled manner. likewise, it would be possible to have only n−1 distance-varying devices 10 in association with n tension legs.

It is even possible to install n−3 distance-varying devices 10 for n tension legs, when the three non-adjustable tension legs are not in alignment so as to define a triangle that is substantially horizontal and thus a substantially horizontal reference plane for the support structure 5 relative to the base 8. Adjusting each of the other tension legs then enables the system to be quasi-isostatic, and thus enables the load on each of the tension legs to be distributed in controlled manner, however these three alternative configurations do not constitute the preferred version of the invention.

Specifically, in a preferred version of the invention, where each of the tension legs has its own distance-varying device 10 enabling the length of each of the tension legs to be varied, there is no difficulty in performing maintenance operations consisting in changing any one of the tension legs without disturbing the operation of the device, and thus avoiding any need to stop oil production. It then suffices:

- to reconnect the duct of hydraulic circuit 13*a* of the ROV 13 to the orifice 11 of the actuator; then
- to unlock the position locking device 12 and release pressure in the actuator so as to relax said tension leg completely; then
- to disconnect the tension leg and replace it with a new tension leg; then
- to retension said tension leg to its initial value; and then
- to lock the position locking device 12 and disconnect the ROV 13.

During such a maintenance operation on a tension leg, which is generally performed after said tension leg has ruptured, the overall force T is temporarily distributed over the n−1 active tension legs, with tensions generally increasing in all of said n−1 tension legs, and subsequently returning to their initial values once a new tension leg has been reinstalled and its own tension readjusted by using the device 10, as explained above. These operations of changing a tension leg may advantageously be performed in preventative manner, e.g. once every five years, so as to avoid problems of fatigue and rupture with the severe consequences that are to be feared.

For simplicity and clarity of explanation, the adjustment and distance-varying device 10 is described above on the basis of a single-acting hydraulic actuator, since measuring the pressure P in the actuator gives very accurate information about the tension T applied in the corresponding tension leg. Nevertheless, it is entirely possible to use a distance-varying device 10 that is constituted by a mechanical actuator using a screw or a rack. However, under such circumstances, it is appropriate for said device also to incorporate a cell for measuring the load or tension applied to said tension leg, such as a dynamometer for reading directly by an ROV, or for transmitting data to the surface for a control station situated on board the floating support so as to be able to adjust the distribution of all of the loads in the various tension legs correctly.

FIG. 6 shows a preferred version of the invention in which the actuator does not have a device 12 for blocking the rod but is blocked hydraulically by leaktight closure 11*b* of the internal chamber of said actuator. The actuator is thus permanently under pressure and a pressure gauge or sensor 11*a* is advantageously installed on a permanent basis on the orifice 11 of said actuator. A permanent display is thus made available showing the tension in each of the tension legs, which tension is correlated with said actuator pressure, and this display can be consulted very simply during routine inspections performed at regular intervals, e.g. by means of an ROV 13. By fitting said orifice with a pressure gauge or sensor 11*a*, information can be transmitted in automatic and permanent manner to the FPSO, either via an electric cable, or acoustically, thus providing a command center with accurate information about all of the hose arches and their anchor systems. In the event of any one of the tension legs rupturing, the command center is immediately informed, and is capable, where applicable, of determining which tension leg has failed. Likewise, in the event of damage to a buoyancy element 6, be that complete rupture or partial invasion, the overall vertical tension will decrease and some of the tension legs 7 will have their tensions drop. The command center of the FPSO is then rapidly informed and can thus launch corrective action.

By way of example, a support structure 5 for supporting troughs 4 may have five to 12 troughs with a radius of curvature lying in the range 1.5 m to 3 m, having a width lying in the range 3 m to 5 m, a length lying in the range 5 m to 30 m, and dead weight in air that may reach or exceed 30 t to 50 t, or even more. The buoyancy incorporated in the support structure 5 or in the form of a float 6*b* situated above said structure is dimensioned so as to compensate for the dead weight of said support structure 5 when fitted with its trough and various accessories that are not shown, together with the dead weight of all of the flexible pipes 1 in catenary configuration. Additional buoyancy is incorporated in the assembly so as to create permanent upward tension lying in the range 3 t to 60 t, and preferably in the range 6 t to 30 t. The device of the invention thus enables the tension to be adjusted in the various tension legs, substantially dividing the above-specified forces by six, so that each of the tension legs is subjected to a permanent tension in the range 0.5 t to 10 t, and preferably in the range 1 t to 5 t. In order to ensure that the device does not fail in the event of a tension leg or an attachment point 7*a*-7*b* failing, or even in certain circumstances in the event of two tension legs or their attachment points failing, the tension legs and their respective attachment points are advantageously dimensioned to have a safety factor of 2 to 4, for example; for a nominal force of 2 t, the tension leg and its attachment points are dimensioned for forces in the range 5 t to 10 t. This avoids problems of fatigue and wear and also the risk of rupture, which even if it occurs, does not in any event put the entire bottom-to-surface connection into danger.

FIGS. 7A to 7C show a said support structure 5 comprising two portions 5-1, 5-2 that are hinged to pivot about a substantially horizontal middle pivot axis X1X'1 so as to allow each of said two hinged-together portions to pivot through an angle alpha lying in the range −10° to +10°, and preferably in the range −5° to +5°, said pivoting being limited by top and bottom abutments 5*a* and 5*b* on each of said two hinged support structure portions. Said two hinged support structure portions are symmetrical in shape and arranged about a vertical midplane containing said pivot axis X1X'1. In practice, the top plane of said first hinged portion 5-1 varies through an angle alpha relative to the top plane of said second hinged portion 5-2. Each of said two hinged portions 5-1, 5-2 is connected to said base via three said tension legs, each connected at one of its ends to a respective distance-varying device (not shown). Each said hinged portion 5-1, 5-2 of said support structure presents a longitudinal shape of substantially rectangular horizontal section that is substantially symmetrical about a longitudinal vertical midplane (YZ), each said hinged portion 5-1, 5-2 of said support structure 5 comprising:

- two top attachment points 7*a*1-7*a*2, 7*a*5-7*a*6 arranged at the longitudinal ends close to the corners of each of said hinged portions that are furthest from said pivot axis (X1-X'1); and
- one top attachment point 7*a*3, 7*a*4 arranged closer to said pivot axis than a said longitudinal end.

The three top attachment points 7*a*1-7*a*2-7*a*3 of said first hinged support structure portion 5-1 are arranged in an isosceles triangle that is symmetrical to the three top attachment points 7*a*4-7*a*5-7*a*6 of the second hinged support structure portion 5-2 about the substantially vertical plane containing said pivot axis.

The term "floating support" is used herein to cover equally well a barge or a ship or a semi-submersible platform of the above-described type.

It should be understood that said top portion of the support structure, supporting or having fastened thereto said troughs of the present invention, is a rigid structure other than a float.

In a particular embodiment, a said flexible pipe is held in a said trough by retaining and/or attachment means. This characteristic seeks to stabilize the set of flexible pipes and to facilitate stresses and movements in said first portions of said flexible pipes.

The trough support structure 5 is a rigid structure, however stresses and movements, in particular at the points of contact between the pipes and the sea floor, are nevertheless considerably reduced as a result of said support structure being tensioned by said float.

In order to make it easier to lay flexible pipes from a laying ship, as explained below in the description, the ends of the troughs include deflectors of profile suitable for avoiding damage to the portion of flexible pipe that might come into contact with said deflector during laying of the flexible pipe on a said bottom trough.

The high point of the bottom of the trough is the point situated halfway along the curvilinear length of the trough.

Said support structure may also support troughs for guiding and supporting flexible lines other than said flexible pipes, and thus of smaller diameter.

For clarity in the figures, the troughs are described as being portions of a truncated torus presenting a circular cross-section of diameter slightly greater than the diameter of the flexible pipe, while the form of the arch in the XZ' plane may equally well be of the type comprising an ellipse, a parabola, or any other curve of varying curvature, with its maximum curvature being less than the limiting critical curvature of said flexible pipe. Likewise, the cross-section of the trough may be of any shape, e.g. it may be U-shaped, it being understood that the inside width of the U-shape in the trough portion is slightly greater than the diameter of the flexible pipe. A locking device (not shown) secures each of the pipes to its respective trough so as to avoid any axial sliding of said hose relative to its own trough.

The various troughs are shown in the figures as having identical radii of curvature, however it is advantageous to adopt radii of curvature that are adapted to each of the pipes, thus enabling overall weight to be minimized and thereby reducing the buoyancy that is needed.

The double catenaries flexible pipes 1*a*, 1*b* deform significantly when the floating support 2 moves as a result of swell, wind, and current. In contrast, the single catenary portions 1*a*1 and 1*b*1 deform very little and thus remain substantially stationary regardless of the movements of the floating support.

The adjustment and distance-varying device 10 is described as being secured at one of its ends either to the base 8 or to the support structure 5, and at its other end to the tension leg, however said device 10 could also be secured at one end to said tension leg and at its other end via a hinge connection, e.g. to a second tension leg, which second tension leg has its other end secured either to the base 8 or the support structure 5. Said device 10 is then arranged between first and second tension legs, however this particular configuration does not constitute the preferred version of the invention.

The invention claimed is:

1. A device comprising a rigid support structure held immersed in a subsurface by floats and anchored to the bottom of the sea by tension legs, said support structure supporting a plurality of arch-shaped support and guide elements, referred to as "troughs", in a bottom-to-surface connection installation between a single floating support and the bottom of the sea, the installation having a plurality of flexible lines comprising flexible pipes extending to the bottom of the sea where said flexible pipes are connected to wellheads, to equipment, or to the ends of undersea pipes resting on the sea bottom, said flexible lines being supported by said plurality of troughs:

wherein said support structure is connected to a base resting on or anchored to the sea bottom by a total number of n tension legs tensioned substantially in parallel by said floats, where n is not less than six, each of a total number of p said tension legs from the n tension legs, where p is not less than n−2, being connected at one end to a distance-varying device, said distance-varying device being connected to said base, or to said support structure, and each of the other ends of the p tension legs being fastened to an attachment element secured to said support structure or to said base, said distance-varying device being connected to or integral with said support structure or said base and suitable for being actuated to vary the distance between said attachment element and said base or said support structure to which said attachment element is fastened or connected; and wherein no end of the tension legs is directly attached to said floats and wherein a top end of said tension legs is fastened at a top attachment element secured to said support structure or to said distance-varying device, a bottom end of said tension legs being fastened at a bottom attachment element secured to said distance-varying device or to said base, wherein said distance-varying device is suitable for:

varying a distance between said top attachment element and said support structure when said distance-varying device is secured to said support structure; or varying a distance between said bottom attachment element and said base when said distance-varying device is secured to said base; and wherein said support structure presents a longitudinal shape of substantially rectangular horizontal section, the device having at least six tension legs, each tension leg being connected to said distance-varying device, and said support structure having at least six top attachment elements, with four of the top attachment elements defining four corners of a rectangle, two other top attachment elements being arranged inside a circle that circumscribes said rectangle, at or in the vicinity of two long sides of the rectangle, the four corner attachment elements being arranged in a proximity of the longitudinal ends of said support structure.

2. The device according to claim 1, wherein said other two top attachment elements are arranged inside said circle that circumscribes said rectangle, at a transverse axis of said rectangle located at a middle of said rectangle.

3. The device according to claim 1, wherein said support structure is supported by and fastened to at least one incorporated bottom float.

4. The device according to claim 1, wherein said support structure comprises two portions that are hinged to pivot about a pivot axis that is substantially horizontal, suitable for allowing each of said two hinged portions to pivot relative to the other through an angle of −10° to +10° relative to horizontal said pivoting being limited by top abutments and bottom abutments of each of said two hinged support structure portions, said two hinged support structure portions being symmetrical about a vertical midplane containing said pivot axis, each of said two hinged portions being connected to said base by at least three said tension legs, an end of at least one said tension leg being connected to a distance-varying device.

5. The device according to claim 4, wherein each said hinged portion of said support structure presents a longitudinal shape of substantially rectangular horizontal section, the device having at least six tension legs, each connected to said distance-varying device, and said support structure has at least six top attachment elements, each said hinged portion of said support structure comprising at least:

two top attachment elements arranged at the longitudinal ends of each said hinged portion that are further from said pivot axis; and one top attachment element arranged closer to said axis of rotation than said longitudinal end.

6. The device according to claim 5, wherein the top attachment elements of said first hinged support structure portion are arranged symmetrically to the three top attachment elements of the second hinged support structure portion about a substantially vertical plane containing said pivot axis.

7. The device according to claim 1, wherein said top attachment elements of said p tension legs are arranged at said support structure and said bottom attachment elements of said p tension legs are arranged at said distance-varying devices, said distance-varying devices being secured to said base, and each said distance-varying device serves to vary the distance between said bottom attachment element and said base.

8. The device according to claim 1, wherein said tension legs are cables or chains.

9. The device according to claim 1, including at least one said distance-varying device comprising an actuator.

10. The device according to claim 9, wherein said bottom attachment element is secured to a movable rod of a hydraulic actuator having an actuator cylinder secured to the base.

11. The device according to claim 9, wherein said actuator includes a pressure gauge or a pressure sensor at an orifice of an actuator cylinder, and a locking device suitable for locking a rod in position by closing an actuator chamber in a leaktight manner.

12. The device according to claim 9, wherein a hydraulic actuator is connected, or is suitable for being connected, to a pressurized fluid feeder unit on board an undersea robot.

13. The device according to claim 1, wherein said support structure supports five to twelve troughs being arch-shaped and having a radius of curvature in the range 1.5 m to 3 m, said support structure having a width lying in the range 3 m to 5 m, and a length lying in the range 10 m to 30 m, and dead weight in air lying in the range 30 t to 50 t, and said support structure has buoyancy incorporated under the troughs so that each said tension leg is subjected to tension lying in the range 0.5 t to 10 t, said tension leg being dimensioned to be suitable for supporting a tension that is two to four times said tension to which said tension leg is subjected.

14. The device according to claim 1, wherein said support structure is a metal lattice structure extending longitudinally in a horizontal direction.

15. The device according to claim 1, wherein said rigid support structure is suspended from at least one immersed top float to which said support structure is connected by flexible connection elements.

16. The device according to claim 1, wherein said support structure supports a plurality of said troughs that are laterally offset in parallel in one direction of said support structure, said troughs being arch-shaped.

17. A bottom-to-surface connection installation between a single floating support and the sea bottom, the installation comprising a plurality of flexible lines with flexible pipes extending from said floating support to the sea bottom, where the flexible lines are connected to wellheads, to equipment, or to the ends of undersea pipes resting on the sea bottom, said flexible lines being supported by a plurality of troughs, each flexible line defining two pipe portions comprising a first flexible line portion in a hanging double catenary configuration between the floating support and one trough of said plurality of troughs, and a second flexible line portion in a single catenary configuration between said one trough and a point of contact of the second flexible pipe portion with the sea bottom, said plurality of troughs being supported by a device according to claim 1.

18. A method of modifying the tensions to which said tension legs of a device according to claim 1 are subjected, wherein at least one of said distance-varying devices is actuated so as to adjust a tension of a tension leg to which said one of said distance-varying devices is connected to have a desired controlled value.

19. The method according to claim 18, wherein the tension of said tension leg to which said one of said distance-varying devices is connected is decreased by actuating said one distance-varying, and then replacing said tension leg.

20. The method according to claim 18, wherein a mechanical connection between various tension legs and said support structure is made mechanically quasi-isostatic by actuating at least one said distance-varying device.

* * * * *